US008319406B2

(12) United States Patent
Radermacher

(10) Patent No.: US 8,319,406 B2
(45) Date of Patent: Nov. 27, 2012

(54) LIGHTING DEVICE AND METHOD OF COOLING A LIGHTING DEVICE

(75) Inventor: Harold Josef Gunther Radermacher, Aachen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 122 days.

(21) Appl. No.: 12/679,324

(22) PCT Filed: Sep. 16, 2008

(86) PCT No.: PCT/IB2008/053754

§ 371 (c)(1),
(2), (4) Date: Mar. 22, 2010

(87) PCT Pub. No.: WO2009/040703

PCT Pub. Date: Apr. 2, 2009

(65) Prior Publication Data

US 2010/0207501 A1 Aug. 19, 2010

(30) Foreign Application Priority Data

Sep. 27, 2007 (EP) ..... 07117424

(51) Int. Cl.
*H01J 1/02* (2006.01)

(52) U.S. Cl. ..... 313/12; 313/498; 362/373; 362/249.02

(58) Field of Classification Search ..... 257/40, 257/72, 98–100, 642–643, 759; 313/498–512, 313/11–12; 438/26–29, 34, 82, 455; 315/169.1, 315/169.3; 427/58, 64, 66, 532–535, 539; 428/690–691, 917; 445/24–25; 362/217.01, 218, 219, 220, 257, 294, 362, 373, 543–549, 217.1, 249.01–249.03, 800

See application file for complete search history.

(56) References Cited

U.S. PATENT DOCUMENTS

| | | | | |
|---|---|---|---|---|
| 5,772,300 | A * | 6/1998 | Kitai | 353/57 |
| 7,144,135 | B2 | 12/2006 | Martin et al. | |
| 7,182,484 | B2 * | 2/2007 | Buelow et al. | 362/294 |
| 2003/0021113 | A1 | 1/2003 | Begemann | |
| 2005/0174780 | A1 | 8/2005 | Park | |
| 2005/0276053 | A1 | 12/2005 | Nortrup et al. | |
| 2007/0070630 | A1 | 3/2007 | Kittredge et al. | |
| 2007/0080360 | A1 * | 4/2007 | Mirsky et al. | 257/99 |
| 2007/0292980 | A1 * | 12/2007 | Hanaoka et al. | 438/26 |
| 2008/0018553 | A1 * | 1/2008 | Umamine et al. | 345/1.3 |

FOREIGN PATENT DOCUMENTS

EP 1471564 A2 10/2004

* cited by examiner

*Primary Examiner* — Mariceli Santiago
*Assistant Examiner* — Donald Raleigh
(74) *Attorney, Agent, or Firm* — John F. Salazar; Mark L. Beloborodov

(57) ABSTRACT

The invention relates to a light device comprising a light source (2), a ventilation unit (3) and a sealed transparent casing (4) sealing the inside (5) of the casing from the outside of the casing (4). The light source (2) and the ventilation unit (3) are located within the casing (4) and the ventilation unit (3) is adapted for generating a gas flow (6, 7) for transporting heat generated by the light source (2) to an inner surface (8) of the casing (4).

8 Claims, 1 Drawing Sheet

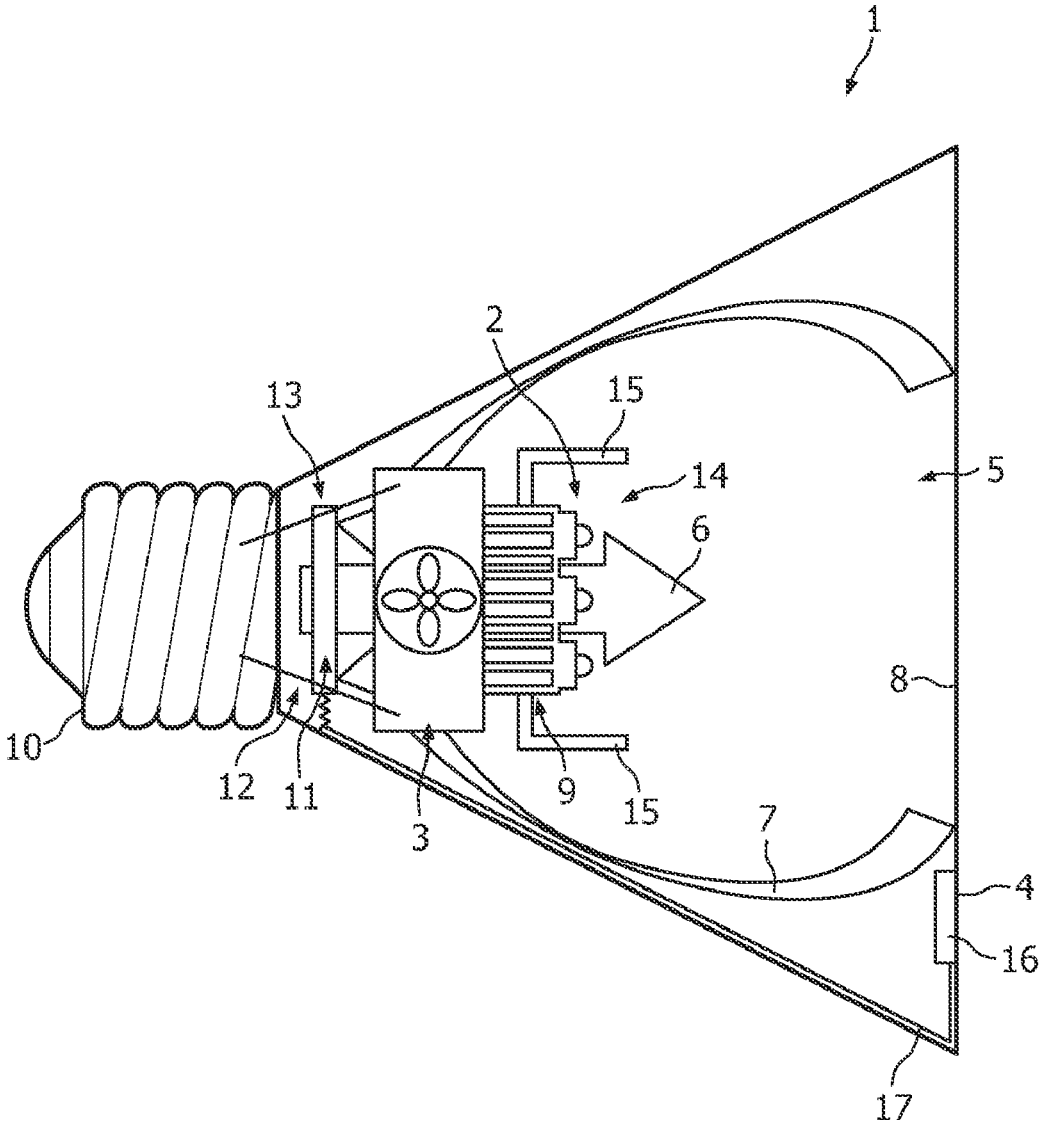
1
2
13
15
14
5
6
8
10
12
11
3
9
15
7
4
16
17

LIGHTING DEVICE AND METHOD OF COOLING A LIGHTING DEVICE

FIELD OF THE INVENTION

The present invention relates to a lighting device and a method of cooling a lighting device.

BACKGROUND OF THE INVENTION

US 2005/0174780 A1 discloses a lighting device comprising light emitting diodes (LEDs) as a light source. The lighting device comprises a socket, which can be electrically connected to a receptacle, and a cooling fan for forcibly circulating air. The cooling fan is received in a main body, which has a plurality of radial partition walls formed in the outer peripheral surface thereof in such a manner as to be spaced apart with a gap between them having a slit shape for ventilation. The LEDs of the lighting device are cooled by the air which is circulated by the cooling fan.

This cooling by circulated air has the drawback that dust and other contaminations from outside the lighting device are transferred to the cooling fan, the LEDs and other elements of the lighting device, such as control electronics for controlling the LEDs and the cooling fan. This contamination reduces the cooling performance over time and the lifetime of the lighting device.

SUMMARY OF THE INVENTION

It is an object of the present invention to provide a lighting device and a method of cooling a lighting device, wherein the cooling performance and the lifetime are increased.

In a first aspect of the present invention a lighting device is presented, wherein the lighting device comprises a light source, a ventilation unit and a sealed transparent casing for sealing the inside of the casing from the outside of the casing, wherein the light source and the ventilation unit are located within the casing and the ventilation unit is adapted for generating a gas flow for transporting heat generated by the light source to an inner surface of the casing.

The invention is based on the idea that by sealing the inside of the casing and locating the ventilation unit within the sealed casing, the ventilation unit cannot be contaminated by particles from outside the casing, for example dust, wherein cooling is performed by generating a gas flow such that heat generated by the light source is transferred to an inner surface of the casing, where the gas flow is cooled down. Since the ventilation unit is not contaminated by particles from outside the casing, these particles cannot degrade the operability of the ventilation unit and can therefore not reduce the cooling performance and the lifetime of the lighting device, i.e. the cooling performance and the lifetime are increased.

In a preferred embodiment, the lighting device further comprises a heat sink coupled to the light source, wherein the ventilation unit is adapted for generating a gas flow for transporting heat generated by the light source from at least one of the light source and the heat sink to the inner surface of the casing. The heat sink increases the surface for the transfer of the generated heat to the gas inside the casing, thereby further improving the cooling performance.

It is preferred that the ventilation unit is mechanically decoupled from the casing. By mechanically decoupling the ventilation unit from the casing, vibrations of the ventilation unit are not transferred to the casing, thereby limiting structure-born noise.

It is further preferred that the lighting device is adapted such that the temperature inside the casing spatially varies during operation and that elements of the lighting device which are located inside the casing are arranged in dependence on the heat resistance of the elements, i.e. in particular the thermal stability or the stability during heating, such that an element having a higher heat resistance is located in a first region within the casing, which has a higher temperature than a second region, in which second region an element having a lower heat resistance is located. Elements of the lighting device are, for example, the ventilation unit, the light source and control units for controlling the ventilation unit and the light source. By arranging at least some of these elements such that an element having a higher heat resistance is located in a region having a higher temperature than a region in which an element having a smaller heat resistance is located, cooling is better adapted to the respective cooling requirements of the different elements, thereby further improving the cooling performance and the lifetime of the lighting device.

It is further preferred that the lighting device is adapted such that the temperature inside the casing spatially varies during operation and that elements of the lighting device which are located inside the casing are arranged in dependence on the heat resistance of the elements, such that regions with similar temperature are provided for elements having a similar heat resistance.

In a preferred embodiment, at least parts of the casing provide electrical isolation between the inner surface of the casing and the outer surface of the casing. This allows, for example, easy cleaning of the outside of the casing and parts of or the entire outside can be touched by a person.

It is further preferred that the lighting device comprises a sensor located inside the casing. This allows providing additional functionality to the lighting device. For example, the sensor can be an optical sensor exposed to the light generated by the light source for controlling the light emission, or the sensor can be a receiver of remote control signals for remote-controlling the light emission. In both exemplary cases the sensor is preferentially connected to the control unit for controlling the light emission depending on signals from the sensor.

It is further preferred that the casing is adapted to mix and/or guide the light generated by the light source. This can improve the lighting performance of the lighting device, in particular without the need of a further optical component for mixing and/or guiding the light, so that the space available within the casing can be improved.

In a preferred embodiment, components inside the casing are interconnected by means of electrically conductive traces on the inner surface of the casing, so that the space available within the casing can be further increased.

In a further aspect of the present invention, a method of cooling a lighting device is presented, wherein the lighting device comprises a light source, a ventilation unit and a transparent casing for sealing the inside of the casing from the outside of the casing, the light source and the ventilation unit being located within the casing, wherein a gas flow is generated for transporting heat generated by the light source to an inner surface of the casing.

It shall be understood that the lighting device of claim 1 and the method of cooling a lighting device of claim 8 have similar and/or identical preferred embodiments, as defined in the dependent claims.

It shall be understood that a preferred embodiment of the invention can also be any combination of the dependent claims with the respective independent claim.

BRIEF DESCRIPTION OF THE DRAWINGS

These and other aspects of the invention will be apparent from and elucidated with reference to the embodiments described hereinafter. In the following drawing:

FIG. 1 shows schematically and exemplarily a sectional view of a representation of a lighting device in accordance with the invention.

DETAILED DESCRIPTION OF EMBODIMENTS

FIG. 1 shows schematically and exemplarily a lighting device 1 in accordance with the invention. The lighting device 1 comprises a light source 2, a ventilation unit 3 and an at least partially transparent casing 4. The light source 2 is, in this embodiment, an arrangement of LEDs, which are coupled to a heat sink 9. In other embodiments, alternatively or in addition, the light source can comprise other kinds of a light generating unit like a laser-based light generating unit. The LEDs can be organic light emitting diodes. The heat sink 9 is preferentially made of metal, preferably aluminum.

The ventilation unit 3 can be any unit which generates a gas flow 6, 7 for transporting heat generated by the light source 2 to an inner surface 8 of the casing 4. In this embodiment the ventilation unit 3 is a fan.

The casing 4 is sealed by a mounting unit 10 for mounting the lighting device 1 to a receptacle. The inside of the casing 4 is sealed from the outside of the casing 4 such that gas from inside and outside the casing 4 cannot be exchanged. Particles from outside the casing 4 can therefore not contaminate elements inside the casing 4, like the ventilation unit 3 and the light source 2, and, thus, the cooling performance is maintained stable and the lifetime is not reduced by these particles. Furthermore, these particles can preferentially not influence the intensity of a color of the emitted light. In addition, insulation distances within the casing 4 can be designed without considering particles like dust from outside the casing. Furthermore, acoustic noise generated by the ventilation unit 3, in particular by vibrations of the ventilation unit 3 and/or by the gas flow inside the casing 4, is eliminated or reduced by the sealing of the casing 4.

Of course, particles can still cover the outer side of the casing. Due to the closed housing, the outer side of the casing can easily be cleaned—even with liquids—if required. In state of the art lighting devices, where the parts of the internal electronics and/or the ventilation unit are exposed to outside air, this would require a substantial effort.

Due to the closed housing, no airborne noise is directly emitted by the ventilation unit to the user. The casing attenuates the airborne noise from the ventilation unit.

The light emitted by the LEDs may be mixed or guided or collimated by some optical elements. These might be additional components made from optical grade plastics or glass or reflectively plated material. In this embodiment the optical element is a reflector 15, which surrounds the LEDs 2 and of which a section is schematically shown in FIG. 1. Alternatively or in addition, the casing or its inner or outer surface may be part of the optical path. In this case, the casing may have a reflective coating or may be arranged to guide the light by total reflection at its inner or outer surface.

The casing 4 is transparent for allowing light generated by the light source 2 to leave the casing 4. The casing 4 can be completely or partly transparent. The casing preferentially forms a light bulb, which surrounds the lighting source and the ventilation unit.

The mounting unit 10 is, in this embodiment, a metal socket having a thread for connecting to a receptacle. The mounting unit can be a standard Edison E27 socket, which seals the casing 4. In a further embodiment, the functions of mounting and electrically contacting may be separated, i.e. the casing may have electrical contacts to e.g. supply energy to the lamp at one position. At a different position, however, the casing may have means for the mechanical mounting.

The ventilation unit 3 generates a gas flow 6 from the light source 2 and the heat sink 9 to the inner surface 8 of the casing 4, where the gas is cooled down. The gas, which has been cooled down at the inner surface 8 of the casing 4, is transported back to the light source 2 and the heat sink 9 by the gas flow 7. FIG. 1 shows schematically and exemplarily certain gas flows 6, 7, the gas flow 6 from the light source 2 and the heat sink 9 to the inner surface 8 of the casing 4 being located substantially in the center of the casing 4 and the gas flow 7 back from the inner surface 8 of the casing 4 to the light source 2 and the heat sink 9 being located substantially adjacent to side walls of the casing 4. In other embodiments, the gas flow can be arranged in another way, for example, the gas flow from the light source and the heat sink to an inner surface of the casing 4 can be located adjacent to the side walls of the casing and the gas flow from an inner surface of the casing to the light source and the heat sink can be located in the center of the casing. Furthermore, the gas flow can be directed to a location on the inner surface of the casing which differs from the location shown in FIG. 1.

As mentioned above, the heated gas is transported to the inner surface of the casing by, for example, the gas flow 6, the gas being cooled down at the inner surface of the casing. Consequently, the wall of the casing is heated, and the outer surface of the casing is preferentially cooled by means of natural convection for transporting the heat to the environment.

In FIG. 1, which is a sectional view of the lighting device 1, the casing 4 has a conical shape, wherein the end portion of the casing 4 having a smaller diameter is coupled to the mounting unit 10 and the end portion of the casing 4 having a larger diameter comprises a planar circular completion. The casing is generally made of an electrical insulation material like glass, i.e. the casing serves preferentially as electrical insulation and the complete internal electronics inside the casing may be life parts, wherein a galvanic insulation is not required.

In the prior art, usually, electrically insulating but thermally conductive sheets or layers are used between life parts and a heat sink of the lighting device. In accordance with the invention, these sheets or layers are not required anymore, since the casing serves as electrical insulation. The thermal interface between the light source and a heat sink can therefore be improved, which results in lower junction temperatures and, thus, an improved cooling performance in comparison to prior art lighting devices.

In other embodiments, the casing 4 can have another shape, for example, a spherical shape, and preferentially comprises some structures on the inner and/or outer surface, for example, ribs, for enlarging the cooling surface of the casing 4.

The lighting device 1 further comprises a control unit 11 for controlling the ventilation unit 3 and/or the light source 2.

The ventilation unit 3, the light source 2, the heat sink 9 and the control unit 11 are, in this embodiment, inflexibly connected to each other and form a block, which is attached to the mounting unit 10 by an attachment unit 12. The attachment unit 12 is constructed such that the block is mechanically decoupled from the mounting unit 10 and, thus, from the casing 4. The attachment unit 12 can be any unit which attaches the block to the mounting unit 10, wherein the block is mechanically decoupled from the mounting unit 10 and, thus, from the casing 4. In this embodiment, the attachment unit 12 is a flexible rubber mounting. In other embodiments, instead of the attachment unit 12, an attachment means can be used which does not mechanically decouple the block, in particular the ventilation unit, from the casing 4. Furthermore, in other embodiments, only some of the elements of the above mentioned blocks can be attached to the casing such that these elements are mechanically decoupled from the casing. In particular, only the ventilation unit can be attached to the casing such that it is mechanically decoupled from the casing.

A first region within the casing 4, which is indicated by reference number 13, is colder than a second region within the casing 4 indicated by reference number 14 in FIG. 1, if the lighting device 1 is in operation and emits light. In the first region 13 the control unit 11 comprising electronics is located and in the second region 14 the light source 2 is located, because the light source 2 has a larger heat resistance than the control unit 11. In other embodiments, in addition or alternatively, also other elements of the lighting device 1 can be arranged within the casing in accordance with their heat resistance.

The casing 4 is, in this embodiment, filled with a gas having a larger heat capacity than air. A gas having a larger heat capacity than air improves the transport of the heat within the casing by the gas flow. Preferentially, the gas inside the casing is an inert gas, in particular helium.

The casing can be adapted, in particular shaped, structured, colored and/or coated, for mixing the light generated by the light source and/or guiding it to an output port, where the light exits the casing to travel to the sensor and/or other locations.

Although in the above described embodiment the lighting device 1 comprises a heat sink 9, in other embodiments, the lighting device can be constructed without such a heat sink, in which case the heat is transported directly from the light source to the inner surface of the casing.

Since the lighting source can be constructed without or with only a small heat sink, sensors can easily be placed within the casing. In this embodiment, a sensor 16 is located within the casing 4. In usual lamps, a lot of the volume of the lamps is used for the heat conducting metal. This occupied volume is unavailable for sensors, electronics, optics, etc. For example, RF antennas (ZigBee controlled lighting device) and/or an optical sensor can be placed in the casing without being shielded or detuned by the presence of a lot of metal, which is usually used to transport the heat to the outer surface of the lighting device. Thus, additional functionality can easily be added to the lighting source. In another preferred embodiment, the sensor is located on the inner surface of the casing and is connected to the control unit 11 by means of conductive traces 17, which are preferentially on the inner surface of the casing.

In a preferred embodiment, the ventilation unit comprises a parallel ventilation structure in which some or all elements within the gas flow are exposed to the same temperature. In such an embodiment, the ventilation unit is preferentially adapted such that the gas flow generated by the ventilation unit is split into several gas flows, some of them being guided to the light source, and others being guided to the control unit. A ventilation unit, which is adapted in such a way, is preferentially used if the heat resistances of the elements are similar.

Preferentially, components inside the casing are interconnected by means of electrically conductive traces on the inner surface of the casing. In a further preferred embodiment, the RF antenna is also made by electrically conductive traces on the inner surface of the casing.

Although in the above described embodiment the ventilation unit is a cooling fan, in other embodiments other kinds of ventilation units and techniques can be used for generating a gas flow for transporting heat generated by the light source 2 to an inner surface of the casing. For example, a unit generating synthetic jets (so called synjets), that rely on trains of turbulent air puffs, or a unit that uses vibration to atomize cooling liquids such as water, can be used as ventilation unit.

Although in the above described FIG. 1 only a first region and a second region having different temperatures during operation of the lighting device are indicated, the lighting device can comprise more than two regions having different temperatures inside the casing, wherein elements of the lighting device can be arranged in the different regions within the casing according to their heat resistance.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

Any reference signs in the claims should not be construed as limiting the scope.

The invention claimed is:

1. A lighting device for insertion into a socket, comprising
- a sealed, at least partially transparent casing; and, disposed within the casing:
- a light source having opposing a first and a second faces and configured to emit light substantially from the first face; and
- a ventilation unit, the ventilation unit proximate to said second face and configured for generating a gas flow to said first face for transporting heat generated by the light source to an inner surface of the casing;
- said casing forming a conical shape wherein a first region has a smaller diameter relative to a second region and adjacent a mounting unit, said second region having a planar circular completion; said first region cooler than said second region when said lighting device is in operation; said first region adjacent said mounting unit and positioned between said ventilation unit and said mounting unit; said second region having said first face of said light source said first face operating at a higher temperature than said second face; said first region spatially separated from said second region.

2. The lighting device as claimed in claim 1 further comprises a heat sink coupled to the light source.

3. The lighting device as claimed in claim 1, wherein the ventilation unit is mechanically decoupled from the casing.

4. The lighting device as claimed in claim 1, wherein the lighting device is adapted such that the temperature inside the casing spatially varies during operation, and wherein elements of the lighting device which are located inside the casing are arranged in dependence on the heat resistance of the elements such that an element having a higher heat resistance is located in a first region within the casing, which has a higher temperature than a second region, in which second region an element having a lower heat resistance is located.

5. The lighting device as claimed in claim 1, wherein a gas having a larger heat capacity than air is located within the casing.

6. The lighting device as claimed in claim 1, further comprises a sensor located within the casing.

7. The lighting device according to claim 1, wherein the casing configured to mix and/or to guide the light generated by the light source.

8. The lighting device according to claim 1, wherein components inside the casing are interconnected by means of electrically conductive traces on an inner surface of the casing.

* * * * *